US005578781A

United States Patent [19]

Suzuki

[11] Patent Number: 5,578,781

[45] Date of Patent: Nov. 26, 1996

[54] TONE SIGNAL SYNTHESIS DEVICE BASED ON COMBINATION ANALYZING AND SYNTHESIZATION

[75] Inventor: Hideo Suzuki, Hamamatsu, Japan

[73] Assignee: Yamaha Corporation, Japan

[21] Appl. No.: 316,122

[22] Filed: Sep. 30, 1994

[30] Foreign Application Priority Data

Oct. 4, 1993 [JP] Japan ..... 5-248342

[51] Int. Cl.[6] ..... G10H 1/12

[52] U.S. Cl. ..... 84/661; 84/DIG. 9

[58] Field of Search ..... 84/661, DIG. 9, 84/622, 453, 454

[56] References Cited

U.S. PATENT DOCUMENTS

| | | | |
|---|---|---|---|
| 4,313,361 | 2/1982 | Deutsch | 84/454 X |
| 4,771,671 | 9/1988 | Hoff | 84/453 X |
| 4,829,872 | 5/1989 | Topic et al. | 84/453 |
| 4,991,484 | 2/1991 | Kawashima | 84/454 X |
| 5,157,218 | 10/1992 | Kunimoto et al. | 84/661 X |
| 5,182,415 | 1/1993 | Kunimoto | 84/661 X |
| 5,187,313 | 2/1993 | Inoue | 84/661 X |
| 5,286,916 | 2/1994 | Yamauchi | 84/661 |
| 5,386,082 | 1/1995 | Higashi | 84/661 X |
| 5,426,262 | 6/1995 | Kitayama et al. | 84/661 X |
| 5,438,156 | 8/1995 | Masuda et al. | 84/661 X |

*Primary Examiner*—Stanley J. Witkowski
*Attorney, Agent, or Firm*—Graham & James LLP

[57] ABSTRACT

There are provided an analyzer which processes a supplied original sound waveform signal so as to generate one or more analyzed waveform signal components, a synthesizer which receives and processes at least one of the analyzed waveform signal components from the analyzer so as to synthesize a waveform signal on the basis of the processing, and a control section which controls the respective parameters used in the analyzer and synthesizer independently of each other. At least output signal of the synthesizer is taken out and output as a tone signal. In order to achieve diversified control of the tone color or characteristic of a tone to be generated, a tone signal may be obtained by taking out the respective output signals of the analyzer and synthesizer for synthesis.

39 Claims, 10 Drawing Sheets

TONE SIGNAL SYNTHESIS DEVICE BASED ON COMBINATION ANALYZING AND SYNTHESIZATION

BACKGROUND OF THE INVENTION

The present invention relates to tone signal synthesis devices suitable for application to various musical instruments such as electronic musical instruments, tone Generation systems, tone processing systems and effectors, and more particularly to such a tone signal synthesis device which synthesizes tone signals on the basis of combination of analyzation and synthesization by the use of a feedback loop system including delay and filter elements.

As methods for generating desired tone waveforms, there is conventionally known one which employs a waveform memory prestoring amplitude values of one or more cycles of tone waveform. This method reproductively produces a tone waveform by repetitively reading out the prestored contents of the memory at a rate proportional to the frequency of a tone to be generated.

A so-called physical model tone source device is also proposed today which synthesizes tone signals by using loop circuitry to electronically approximate physical characteristics of a vibrating object. In this tone source device, delay circuitry is inserted in the loop circuitry to control delay times so that the fundamental pitch of a tone signal is controlled, and filtering elements are also inserted in the loop circuitry to control the tone color.

However, the tone waveform produced by the above-mentioned waveform-readout method is always a mere repetition of a same waveform, and thus, with this method, it is very difficult to generate expressive tones full of variety. Besides, various additional waveform processing must be performed on the tone waveform read out from the memory in order to change the tone color. This waveform-readout method, even if it is combined with the physical model tone source, encounters great difficulty in achieving substantial tonal variety by changing filter constants etc.

SUMMARY OF THE INVENTION

It is therefore an object of the present invention to provide a tone signal synthesis technique which permits synthesis of tones of tone colors or characteristics full of variety.

It is another object of the present invention to provide a tone signal synthesis technique which allows tones of tone colors or characteristics full of variety to be synthesized by simple control.

To achieve the above-mentioned objects, a tone signal synthesis device in accordance with the present invention comprises a section for providing an original sound waveform signal, an analyzation section including a first signal circulation loop having a delay element and a filter element, the analyzation section supplying a signal based on the original sound waveform signal to the first signal circulation loop for processing thereby and outputting a signal obtained from analyzing the original sound waveform signal on the basis of the processing by the loop, a synthesization section including a second signal circulation loop having a delay element and a filter element, the synthesization section forwarding the signal output from the analyzation section to the second signal circulation loop for processing thereby and outputting a signal obtained from the processing by the second signal circulation loop, a control section for controlling parameters that determine the respective processing characteristics of the analyzation and synthesization section, independently of each other, and an output section for taking out at least the signal output from the synthesization section so as to output the taken-out output signal as a tone signal.

According to the present invention, analysis of an original sound waveform signal can be performed by the processing of the analyzation section, and a waveform signal output resultant from the processing corresponds to a sort of waveform analysis data. In other words, the waveform signal output based on the processing of the analyzation section contains at least resonant component because of the characteristics of the signal circulation loop that includes delay and filter elements. If additional analyzation processing is performed to separate the resonant component from the original sound waveform signal, it is allowed to obtain a signal, as a difference between the original signal and the resonant component, corresponding to the changed content. Further, by passing the analyzed waveform signal output through a loop of the synthesization section, it is allowed to synthesize a waveform signal containing resonant component. In such a case, by providing the analyzation and synthesization sections with parameters in a common manner to each other, it is also possible for the synthesization section to obtain a tone signal that is exactly a carbon copy of the original sound waveform signal. But, in order to achieve, using a relatively simple method, diverse controllability of tone color or characteristic of a tone to be generated, the present invention is characterized by provision of the control section which controls parameters that determine the respective processing characteristics of the analyzation and synthesization sections independently of each other. Thus, the relationship between the parameters of the analyzation section and the parameters of the synthesization section can be varied in a variety of ways, so the tone color or characteristic of a tone to be synthesized can be controlled in a variety of ways. In other words, various tones ranging from the one exactly resembling the original sound to the one completely different from the original sound can be synthesized in a controlled manner as desired by the user. Accordingly, even when the original sound waveform signals supplied are a mere repetition of one-cycle waveform read out from memory, tone signals having complex waveform components and time-varying characteristics can be synthesized by application of the present invention. It should be obvious that, even when the original sound waveform signals supplied are of a complex waveform time-varying over a plurality of cycles, application of the present invention permits synthesis of tone signals that have been imparted even more diversified tone color or characteristic control. In addition, even when the original sound waveform signals supplied are realtime-performed sound picked by a microphone, for example, it is possible to perform free tone color variation or effect impartment on the realtime-performed sound by processing the sound using the principle of the present invention.

A preferred form of the analyzation section includes an operation or calculation section for obtaining a difference between the original sound waveform signal and a signal taken out from the first signal circulation loop, and the output signal of the operation section is supplied to the first signal circulation loop. In this way, analyzation processing on the resonant component is carried out by the first signal circulation loop, and the operation section analyzes a difference or changed content between the original sound waveform signal and the resonant component.

In order to provide for effective diversified control of the tone or characteristic of a tone to be synthesized, it is preferred that the respective outputs of the analyzation and synthesization sections are taken out or extracted for synthesis so that the synthesized result is output as a tone signal. The synthesis of the outputs of the analyzation and synthesization sections may be carried out in a variety of ways, as will be detailed later in Description of the Preferred Embodiments of the Invention. For instance, tone signal controllable with diversified variations can be synthesized by respectively weighting or gain-controlling, as desired, at least one of the resonant component and difference content signals analyzed by the analyzation section, and the waveform signal synthesized by the synthesization section, and then additively or subtractively combining these weighted signals. For instance, in the case of piano sound, an attack sound initially generated upon key depression has many of characteristics peculiar to a percussive sound caused by initial string vibration, and a succeeding sound based on subsequent string vibration has many resonant components because of the string's periodic vibration. Therefore, if the original sound waveform signal is of a piano sound, the analyzed difference component signal, from which resonant component has been removed, will more noticeably presents the characteristics of an attack sound initially generated upon key depression, and the analyzed resonant component signal will more noticeably presents a sound based on an after-depression string vibration. Thus, by variably controlling the synthesis ratio in a tone where a plurality of signal components analyzed by the analyzation section are finally combined, or by performing variable control as to which of the analyzed signal components should be input to the synthesization section and how the input component should be synthetically processed, it is allowed to freely realize partial emphasis and modification of the analyzed signal components, thus making the tone synthesis method full of variety.

Now, the preferred embodiments of the present invention will be described in detail below with reference to the accompanying drawings.

DESCRIPTION OF THE PREFERRED INVENTION

First, with reference to FIGS. 10A and 10B, a description will be given on a tone synthesis system on which various embodiments of the present invention are based. The tone synthesis system is capable of faithfully reproducing original sounds and further editing the reproduced sounds so as to synthesize new tones.

Figure 10A:
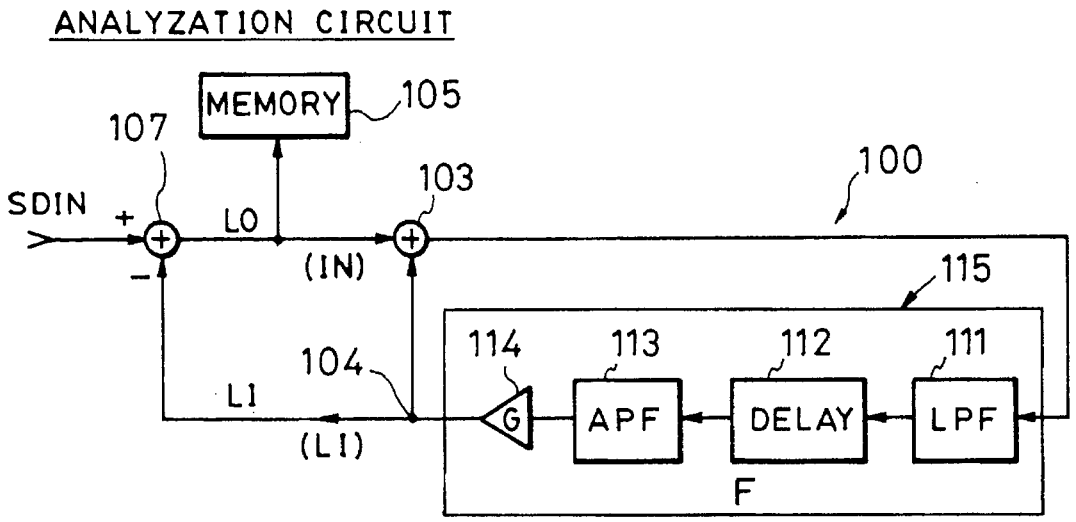
FIG. 10A is a block diagram of a typical example of an analyzation circuit.
Figure 10B:
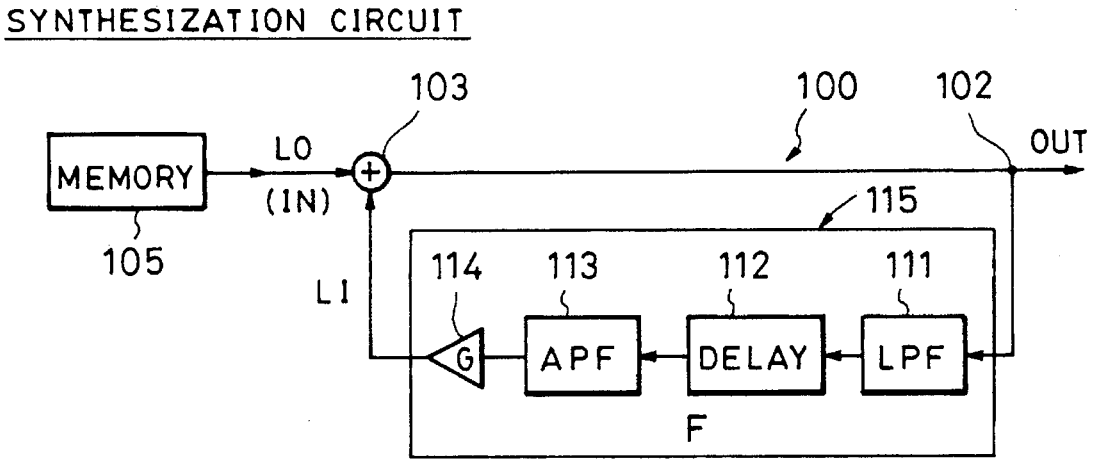
FIG. 10B is a block diagram of a typical example of a synthesization circuit.

FIGS. 10A and 10B illustrate the principal parts of a tone source device employed in an electronic musical instrument. FIG. 10A is a block diagram of an analyzation circuit, while FIG. 10B is a block diagram of a synthesization circuit.

In FIG. 10A, the analyzation circuit comprises a loop circuit 100, which includes an adder 103 and a function circuit 115. The function circuit 115 includes a low-pass filter 111, a delay circuit 112, an all-pass filter 113 and a gain control 114. Here, the impulse response of the function circuit 115 is represented as "F".

An input signal SDIN is applied to the adder 103 via an adder (subtracter) 107, and the output signal LO of the subtracter 107 is stored into a memory 105. Further, the output signal LI from the function circuit 115 is fed back to the minus input terminal of the subtracter 107 via a junction 104.

The operation of the analyzation circuit of FIG. 10A will be described as follows. The output signal LO from the subtracter 107 can be represented as $$LO=SDIN-LI \quad (1)$$

The difference signal LO is stored into the memory 105 and is also applied to the input terminal of the adder 103 that serves as the signal introduction terminal to the loop circuit 100. The adder 103 adds together the output signal LI from the function circuit 115 and the output signal LO from the subtracter 107 and then supplies the resultant sum signal (LI+LO) to the loop circuit 100. This sum signal (LI+LO) becomes a signal F·(LI+LO) by passing through the function circuit 115. Because this signal is the output signal LI of the function circuit 115, the following equations result:

$$LI=F\cdot(LI+LO)$$

$$\therefore LI=\{F/(1-F)\}LO \quad (2)$$

Therefore, from the above equations (1) and (2), there is obtained $$SDIN-LI=SDIN-\{F/(1-F)\}LO=LO \quad (3)$$

The equation (3) can be rewritten as $$SDIN=\{1+F/(1-F)\}LO=LO/(1-F) \quad (4)$$

The synthesization circuit of FIG. 10B comprises a loop circuit 100 and a memory 105 which are the same as in the analyzation circuit of FIG. 10A. The memory 105 outputs the signal LO having been previously stored in the analyzation circuit. If the output from the function circuit 115 is "LI" as in FIG. 10A, an adder 103 provides output signal (LO+LI) which is then taken out as output signal OUT from a junction 102. Namely, the output signal OUT can be represented as $$OUT=LO+LI \quad (5)$$

Since the signal LI is produced by the output signal OUT passing through the function circuit 115, there is obtained $$LI=F\cdot OUT \quad (6)$$

Thus, to rearrange the above equations (5) and (6), there is obtained $$LO+F\cdot OUT=OUT$$

$$OUT=LO/(1-F) \quad (7)$$

Therefore, as will be readily understood from comparison with the equation (4), the output signal OUT becomes equivalent to the input signal SDIN to the analyzation circuit.

In FIG. 10A, if it is assumed that the input signal SDIN is applied to the input terminal of the analyzation circuit and the input terminal of the memory is the output terminal of the analyzation circuit, the characteristic of the circuit can be represented on the basis of equation (4) as $$LO=SDIN\cdot(1-F)$$

Namely, it can been seen that the analyzation has an opposite characteristic to that of the synthesization circuit OUT=LO/(1−F).

With the tone source device comprising the analyzation and synthesization circuits as shown in FIGS. 10A and 10B, it is possible to reproduce input external sounds by analyzing the input external sounds for storage of the analyzed results and then producing tone signals using the thus-stored analyzed results.

The above description has been made on the presupposition that various characteristic parameters such as the cut-off frequency of the low-pass filter 111, delay time of the delay circuit 112, phase variation amount of the all-pass filter 113 and gain of the gain control 14 are fixed at respective predetermined values. However, it should be appreciated that by changing the various characteristic parameters of the function circuit 115 during analyzation and synthesization, it is also possible to produce tone signals having additional new tone colors on the basis of the sampled sounds.

The present invention seeks to provide a tone synthesis device which is capable of imparting additional tone colors to original, sampled sounds by the use of the above-mentioned analyzation and synthesization circuits.

Figure 1:
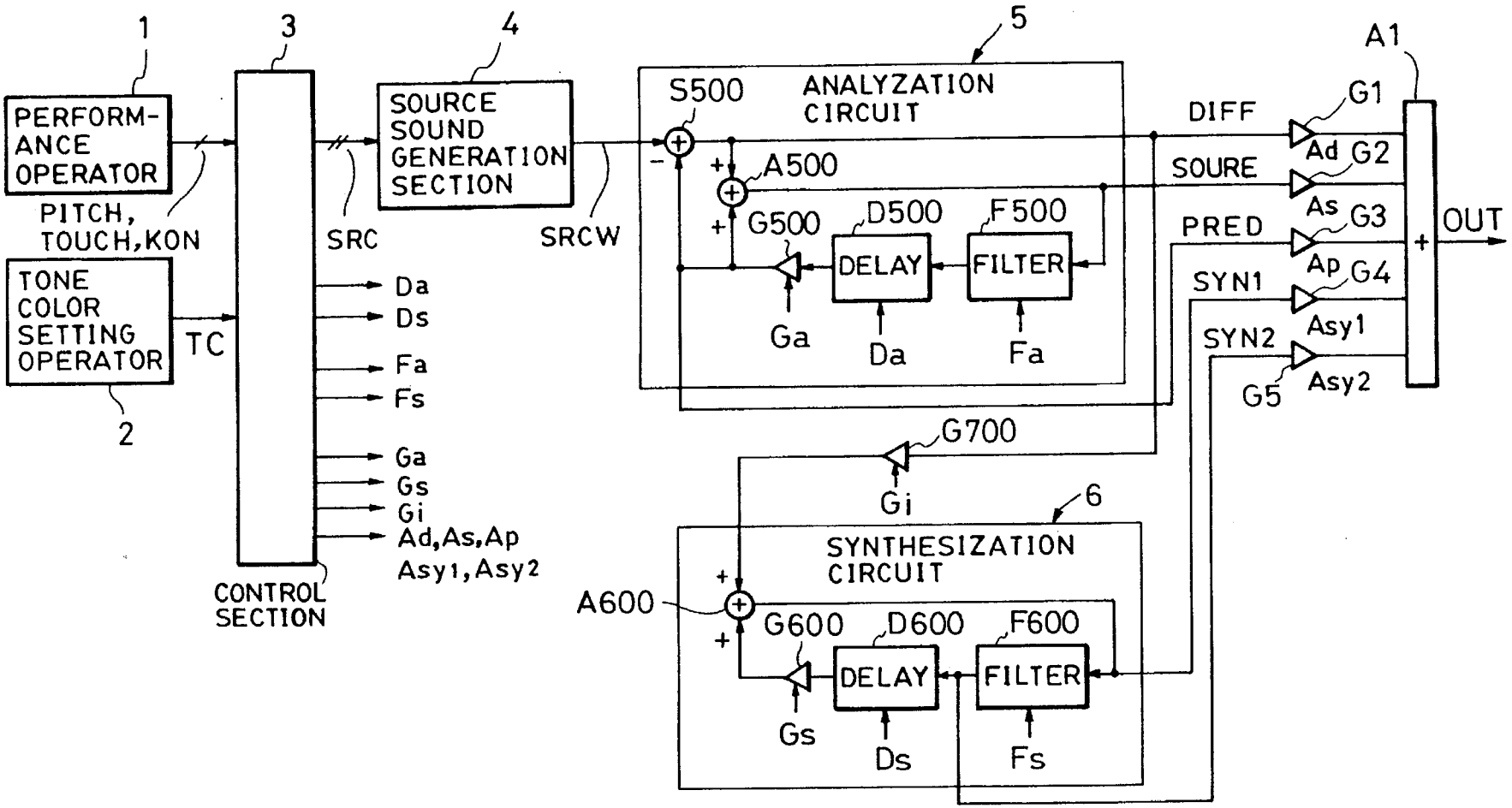
FIG. 1 is a block diagram of an embodiment of a tone signal synthesis device in accordance with the present invention.

FIG. 1 is a block diagram of a tone source device according to an embodiment of the present invention, which comprises an analyzation circuit and a synthesization circuit as shown in FIGS. 10A and 10B.

In FIG. 1, a performance operator 1 such as a keyboard and a tone color setting operator 2 such as a group of tone color switches produce respective outputs which are provided to a control section 3. For instance, the performance operator 1 produces pitch signal PITCH, touch signal TOUCH, key-on signal KON and the like, while the tone color setting operator 2 produces tone color signal TC and the like in response to the user's depression of a desired tone color switch.

The control section 3 produces an original or source sound designation signal SRC on the basis of the pitch signal PITCH, tone color signal TC etc. and provides the signal SRC to an original or source sound waveform generation section 4. The source sound waveform generation section 4 in turn produces an original or source sound signal SRCW as designated by the source sound designation signal SRC. The source sound waveform generation section 4 may comprise any suitable tone source, such as a sampling-type tone source where sampled source sounds are stored, an FM-type tone source, an additive-synthesis-type tone source or a physical model tone source.

Further, on the basis of the pitch signal PITCH and tone color signal TC, the control section 3 produces various parameters to be supplied to an analyzation circuit 5 and a synthesization circuit 6, among which are a filter coefficient Fa to be supplied to a filter F500 of the analyzation circuit 5, a delay coefficient Da to be supplied to a delay circuit D500, a gain Ga to a gain control G500, a filter coefficient Fs to a filter F600 of the synthesization circuit 6, a delay coefficient Ds to a delay circuit D600, a gain Gs to a gain control G600, and gains Gi, Ad, As, Ap, Asyl, Asy2 to gain controls G700, G1, G2, G3, G4, G5.

The analyzation circuit 5 is similar to the one illustrated in FIG. 10A and comprises a loop circuit that includes an adder A500, a filter F500, a delay circuit D500 and a gain control G500. The source sound SRCW is provided from the source sound waveform generation section 4 to the analyzation circuit 5, where the signal SRCW is applied to the adder A500 by way of a subtracter S500.

The output of the subtracter S500 forms a differential sound DIFF which is a first output of the analyzation circuit 5. Further, the output of the gain control G500 constituting the loop circuit is fed back to the minus terminal of the subtracter S500 and also forms a predicted sound PRED which is a second output of the analyzation circuit 5.

According to the embodiment, the differential sound DIFF represents a difference, i.e., an amount of change between waveforms of a present tone signal and a tone signal delayed by the loop circuit. Physically, the differential sound DIFF corresponds to non-periodic component such as a collision sound produced by, for example, striking a string of piano. The predicted sound PRED represents resonant component coinciding with the resonance characteristic of the loop circuit. Further, the output of the adder A500 represents a sum of the resonant sound and differential sound, assumes a tone waveform similar to that of the source sound SRCW and forms a source sound SOURCE that is a third output of the analyzation circuit 5.

The first output, i.e., differential sound DIFF of the analyzation circuit 5 is provided via the gain control G700 to one terminal of the adder A600 of the analyzation circuit 6.

The synthesization circuit 6 is similar to the one illustrated in FIG. 10B and comprises a loop circuit that includes the adder A600, a filter F600, a delay circuit D600 and a gain control G600. The output of the adder A600 forms a synthesized sound SYN1 that is a first output of the synthesization circuit 6, and the output of the filter F600 forms another synthesized sound SYN2 that is a second output of the synthesization circuit 6. If the gain value of the gain control G700 is "1" and the characteristics of the filter F600, delay circuit D600 and gain control G600 in the loop circuit are equivalent to those of the filter F500, delay circuit D500 and gain control G500, respectively, the synthesized tone SYN1 will coincide with the source sound signal SRCW as previously noted in relation to FIGS. 10A and 10B.

The differential sound DIFF, source sound SOURCE and predicted sound PRED output from the analyzation circuit 5 and the synthesized sounds SYN1, SYN2 output from the synthesization circuit 6 are all input to an adder A1 via gain controls G1, G2, G3, G4 and G5, respectively. The adder A1 sums up these input sounds to create tone signal OUT.

The use of the thus-constructed tone source device allows differential and predicted sounds to be utilized for tone synthesis and hence can achieve increased flexibility in tone color impartment. Further, in the case where tone synthesis is performed using the synthesization circuit of FIG. 10B alone, tone color is imparted by only changing the parameters of the synthesization circuit; however, this embodiment can also perform real-time control of each individual parameter of the analyzation circuit during tone generation and hence can provide extensive tone color control.

For example, by shifting the cut-off frequency of the filter F600 above or below the cut-off frequency Fa of the filter F500, it is allowed to produce a tone having a tone color somewhat different from that of the source sound so as to achieve a duet effect. Further, by reducing the delay time Ds of the delay circuit D600 to the half of the delay time Da of the delay circuit D500, it is allowed to obtain a tone that is one octave higher than the source sound.

Furthermore, by controlling the gains Ga and Gs of the gain controls G500 and G600, it is allowed to independently vary the amplitude envelopes of the predicted sound PRED derived from the analyzation circuit 5 and of the synthesized sounds SYN1 and SYN2 of the synthesization circuit.

It is possible to generate tones of various tone colors by weighting the thus-obtained differential sound DIFF, source sound SOURCE, predicted sound PRED and synthesized sounds SYN1 and SYN2 by means of the gain controls G1 to G5 and summing up the weighted sounds. For example, if it is desired to emphasize an attack tone, it suffices to increase the gain Ad of the differential sound DIFF to be greater than the gain Ap of the predicted sound PRED.

Conversely, if it is desired to weaken an attack tone and strengthen a resonant tone, it suffices to decrease the gain Ad of the differential sound DIFF to be smaller than the gain Ap of the predicted sound PRED. By setting to "0" all the gains other than the gain As of the gain control G2 which controls the gain of the source sound SOURCE, it is also possible to produce a same tone as the source sound.

In addition, controlling the gain Gi of the gain control G700 makes it possible to balance the analytic outputs comprising the differential sound DIFF, source sound SOURCE and predicted sound PRED and the synthetic outputs comprising the synthesized sounds SYN1 and SYN2.

Description has so far been made on the fundamental structure comprising a combination of one analyzation circuit and one synthesization circuit, a variety of modifications to the fundamental structure are possible in order to impart various different tone colors and to create novel tones. Several modified embodiments contemplated on the basis of the fundamental structure of FIG. 1 will now be described below.

Figure 2A:
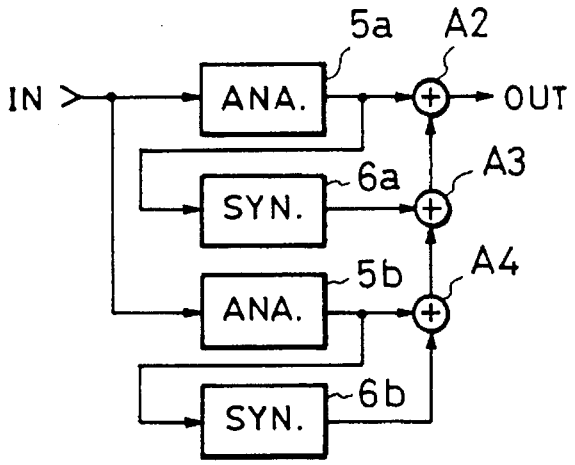
FIG. 2A is a schematic block diagram of another embodiment of the present invention, showing an example of a system comprising a combination of a plurality of the analyzation and synthesization circuits of FIG. 1.

FIG. 2A to 2E show examples of a first modified embodiment, in which a plurality of analyzation and synthesization circuits are connected in various patterns. In the example of FIG. 2A, there are connected, in parallel, an analyzation/synthesization system composed of an analyzation circuit 5*a* and a synthesization circuit 6*a*, and another analyzation/synthesization system composed of an analyzation circuit 5*b* and a synthesization circuit 6*b*. The analyzation circuits 5*a* and 5*b* are of the same construction but can be controlled independently of each other. Similarly, the synthesization circuits 6*a* and 6*b* are of the same construction but can be controlled independently of each other.

A same source sound signal IN is input to the analyzation circuits 5*a* and 6*a*. Outputs of the analyzation circuits 5*a* and 5*b* and the synthesization circuits 6*a* and 6*b* are added together by means of adders A2, A3 and A4 to provide output signal OUT. Although two analyzation/synthesization systems are connected in parallel in the illustrated example of FIG. 2A, three or more analyzation/synthesization systems may be connected in parallel.

Further, each output of the analyzation circuits 5*a* and 5*b* and the synthesization circuits 6*a* and 6*b* is shown in FIG. 2A as a single solid line, but, in practice, the output of each analyzation circuit 5*a* and 5*b* may contain differential sound DIFF, source sound SOURCE and predicted sound PRED and the output of each synthesization circuit may contain synthesized sounds SYN1 and SYN2, as previously mentioned in relation to FIG. 1. Additionally, the respective outputs of the circuits 5*a*, 5*b*, 6*a*, 6*b* may be added by the adders A2, A3 and A4 after having been weighted via gain controls provided on the input sides of the individual adders A2, A3 and A4. This weighting feature may be similarly applied to other examples as shown in FIGS. 2B to FIG. 2E.

Figure 2B:
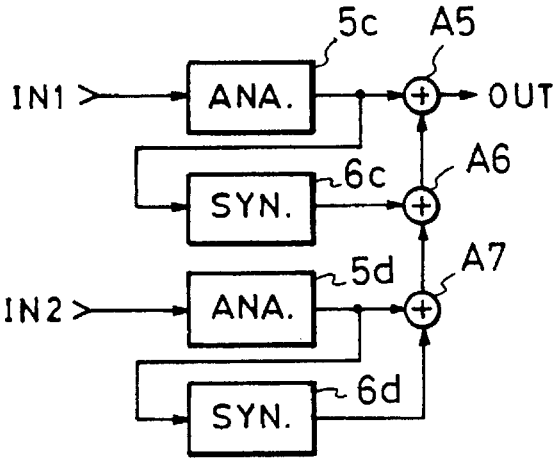
FIG. 2B is a schematic block diagram of another embodiment of the present invention, showing another example of a system where a plurality of the analyzation and synthesization circuits of FIG. 1 are combined.

FIG. 2B shows another example where an analyzation/synthesization system composed of an analyzation circuit 5*c* and a synthesization circuit 6*c* is connected in parallel with another analyzation/synthesization system composed of an analyzation circuit 5*d* and a synthesization circuit 6*d*. This example is different from that of FIG. 2A in that a source sound signal IN1 is input to the analyzation circuit 5*c* and another source sound signal IN2 is input to the analyzation circuit 5*d*.

Outputs of the analyzation circuit 5*c* and 5*d* and the synthesization circuits 6*c* and 6*d* are added together by means of adders A5, A6 and A7 to provide output signal OUT. Although two analyzation/synthesization systems are connected in parallel in the illustrated example of FIG. 2B, three or more analyzation/synthesization systems may be connected in parallel.

Figure 2C:
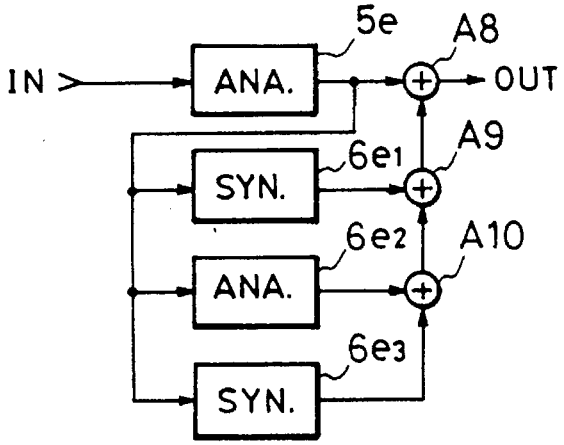
FIG. 2C is a schematic block diagram of still another embodiment of the present invention, showing another example of a system where a plurality of the analyzation and synthesization circuits of FIG. 1 are combined.

FIG. 2C shows still another example where output of a single analyzation circuit is input to a plurality of synthesization circuits connected in parallel with each other. A source sound signal IN is input to an analyzation circuit 5e, and a differential sound DIFF output from the analyzation circuit 5e is input to three synthesization circuits 6e1, 6e2 and 6e3 of different characteristics. The output of the analyzation circuit 5e and outputs of the synthesization circuits 6e1, 6e2 and 6e3 are added together via adders A8, A9 and A10 to form output signal OUT. Although three synthesization circuits are connected in parallel in the illustrated example of FIG. 2C, the number of the synthesization circuits may be other than three as long as it is plural.

Figure 2D:
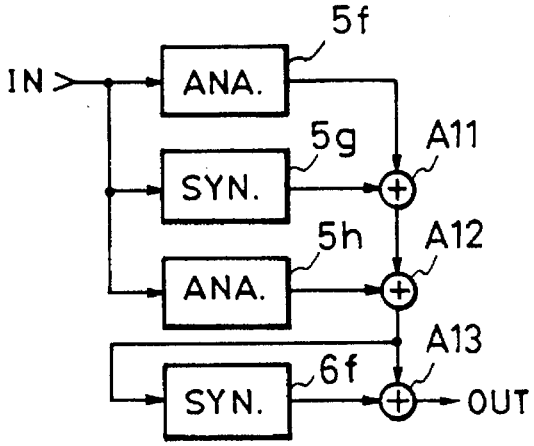
FIG. 2D is a schematic block diagram of still another embodiment of the present invention, showing another example of a system where a plurality of the analyzation and synthesization circuits of FIG. 1 are combined.

FIG. 2D shows still another example where a plurality of analyzation circuits are connected in parallel with each other and the sum of respective outputs of the analyzation circuits is provided to a single synthesization circuit. A source sound signal IN is input to three analyzation circuits 5f, 5g and 5h of different characteristics. Differential sounds output from the analyzation circuits 5f, 5g and 5h are added together by means of adders A11 and A12 to be provided to an synthesization circuit 6f. The outputs of the analyzation circuits 5f, 5g and 5h and output of the synthesization circuit 6f are added together via the adders A11, A12 and A13 to form output signal OUT. Although three analyzation circuits are connected in parallel in the illustrated example of FIG. 2D, the number of analyzation circuits may be other than three as long as it is plural.

Figure 2E:
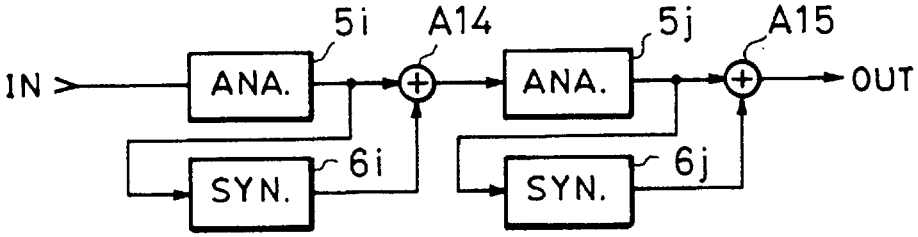
FIG. 2E is a schematic block diagram of still another embodiment of the present invention, showing another example of a system where a plurality of the analyzation and synthesization circuits of FIG. 1 are combined.

FIG. 2E shows yet another example where an analyzation/synthesization system composed of an analyzation circuit 5i and a synthesization circuit 6i and another analyzation/synthesization system composed of an analyzation circuit 5j and a synthesization circuit 6j are connected in series with each other. A source sound signal IN is input to the analyzation circuit 5i. Outputs of the analyzation and synthesization circuits 5i and 6i are added by an adder A14 to be provided to the analyzation circuit 5j. Outputs of the analyzation and synthesization circuits 5j and 6j are added by an adder A15 to form output signal OUT.

Although analyzation/synthesization systems each composed of an analyzation circuit and a synthesization circuit are connected in series with each other in the example of FIG. 2E, each of the analyzation/synthesization systems may be composed of a plurality of analyzation circuits or synthesization circuits. Alternatively, more than two analyzation/synthesization systems may be connected in series with each other.

As has been described above, by connecting a plurality of analyzation and synthesization circuits in various manners, it is possible to variously process source sound signals to thereby form novel tone signals. For example, by adding together respective outputs of synthesization circuits having different characteristics, it is possible to achieve an ensemble effect. Further, it is possible to obtain novel tone signals by adding differential sounds analyzed by a plurality of analyzation circuits and providing the added result to a synthesization circuit.

Figure 3A:
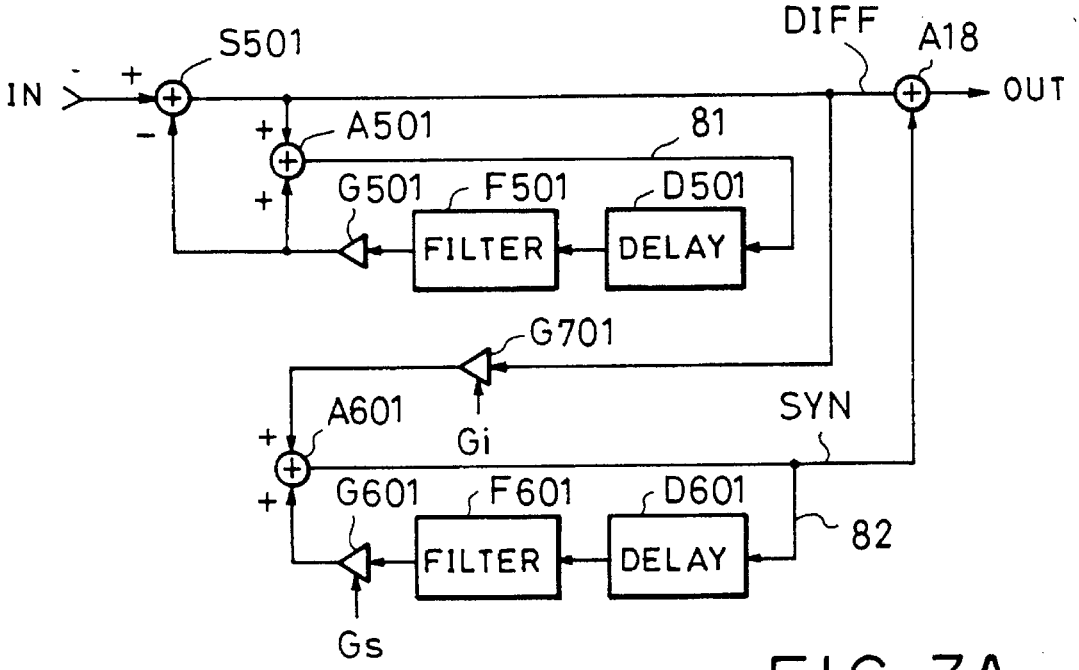
FIG. 3A is a block diagram of another embodiment of a tone signal synthesis device in accordance with the present invention.
Figure 3B:
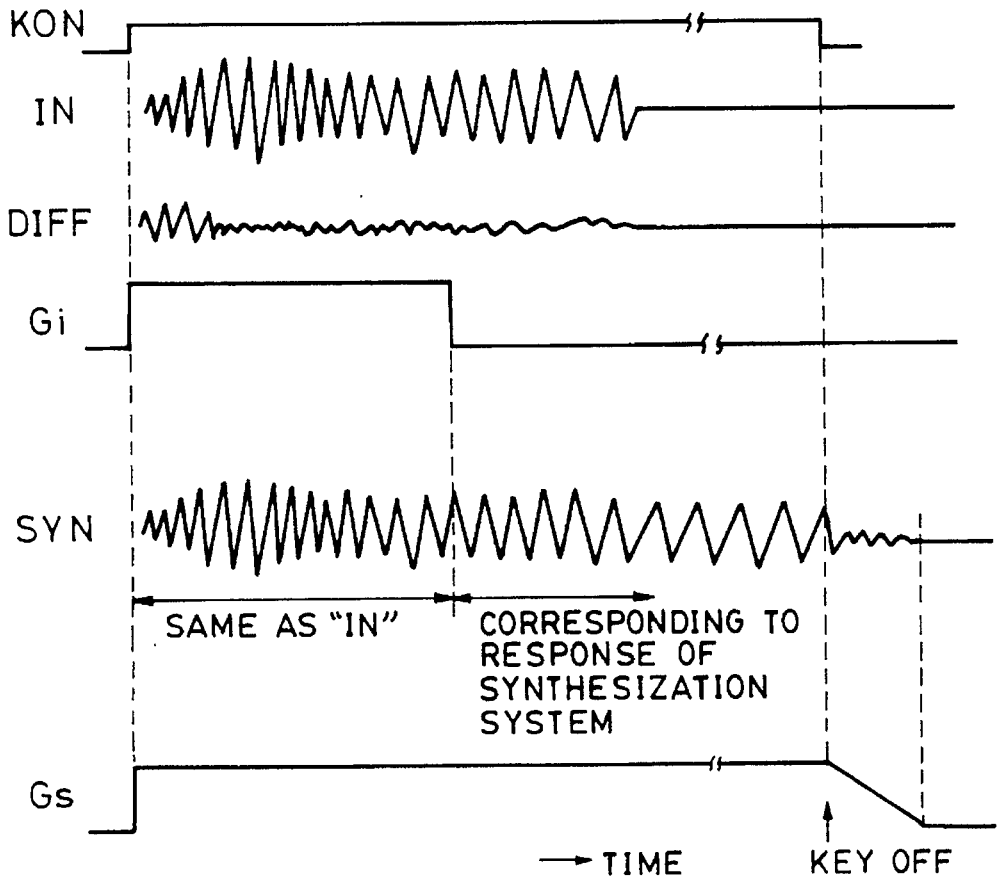
FIG. 3B is a timing chart explanatory of the operation of the synthesis device of FIG. 3A.

FIGS. 3A and 3B show a second embodiment of the present invention in which tone signal is created by, at a predetermined time after tone generation timing, stopping supply of differential sound DIFF from an analyzation circuit to a synthesization circuit.

FIG. 3A is a block diagram of the analyzation and synthesization circuits. The analyzation circuit comprises a loop circuit 81 including an adder A501, a delay circuit D501, a filter F501 and a gain control G501, and also a subtracter S501. The subtracter S501 subtracts an output signal of the gain control G501 input at its "–" terminal from a source sound signal IN input at its "+" terminal, so as to form a differential sound DIFF. The differential sound DIFF is applied to one input terminal of the adder A501 and is also taken out as an output of the analyzation circuit which is then supplied to an adder A18 and a gain control G701.

The differential sound DIFF is imparted an envelop-defining gain Gi by the gain control G701 and is then supplied to an adder A601 of the synthesization circuit A601. The gain Gi imparted by the gain control G701 is maintained at a value of "1" for a predetermined time after the tone generation timing and is changed to "0" after the lapse of the predetermined time from the tone generation timing.

The synthesization circuit of FIG. 3A comprises a loop circuit 82 including the adder G601, a delay circuit D601, a filter F601 and a gain control G601. A synthesized sound SYN formed by the adder A601 is taken out or extracted as an output of the synthesization circuit so as to be supplied to the adder A18. To the gain control G601 is supplied a gain Gs from the control section not shown in FIG. 3A. The adder A18 adds the differential sound DIFF and synthesized sound SYN to form output signal OUT. It is assumed that the source sound is a tone of a percussive stringed instrument such as a piano.

FIG. 3B shows respective signal waveforms of the source sound signal IN, differential sound DIFF, gain Gi, synthesized sound SYN, gain Gs and key-on signal KON in the analyzation/synthesization system of FIG. 3A. Once a key is depressed, the key-on signal KON becomes "1". The control section 3 shown in FIG. 1 sends a source sound designation signal SRC to the source sound waveform generation section 4 and sets both the gains Gi and Gs at "1". The source sound waveform generation section 4, in turn, produces and outputs a source sound signal IN to the subtracter S501.

Upon receipt of the source sound signal IN, the subtracter S501 produces and outputs a differential sound DIFF. As may be well known, tone of a piano or the like will have drastic changes during the attack portion, but constant resonant sound components will dominate upon entry in the sustain portion. The differential sound DIFF corresponds to such changes and initially has great amplitudes, but soon, the amplitude gradually decreases since resonant sound signal is excited by the loop circuit 81 and the excited signal is subtracted from the source sound signal by the subtracter S501. Such changes are found in the signal waveform DIFF of FIG. 3B. When the differential sound DIFF is small in amplitude, the output tone signal OUT is only slightly influenced by the sound DIFF.

At first, because the gain Gi is at a value of "1" the differential sound DIFF is supplied to the adder A601 without being changed at all. This causes the synthesized sound SYN to be excited in the loop circuit 82. Such conditions are found in the waveform SYN of FIG. FIG. 3B. If the individual elements of the loop circuit 91 are coincident in characteristics with those of the loop circuit 82, the synthesized sound SYN will become equivalent to the source sound signal IN.

The gain Gi is set to "0" when the amplitude of the differential sound DIFF has decreased below a predetermined value. This causes the input signal to one input terminal of the adder A601 to become a value of "0", so that the loop circuit 82 independently continues its resonant excitation. Accordingly, after the gain Gi is set to "0" as shown, the synthesized sound SYN becomes tone signal that is generated irrespective of then-input source sound signal IN. So, the synthesized sound continues to be generated even if no source sound is present.

Upon release of the key in question, the key-on signal KON becomes "0"; in the case of tone of piano or the like, attenuation of the release portion commences. Once the key-on signal KON becomes "0", the control section gradually decreases the gain Gs, so as to make the gain Gs "0" after lapse of a predetermined time. Such conditions are found in the Gs waveform of FIG. 3B. This causes the feedback gain of the loop circuit 82 to decrease, so that the synthesized sound SYN gradually attenuates. Such conditions are found in the SYN waveform of FIG. 3B.

In tone sources of the waveform memory readout type, for example, it is allowed to restrict the length of each waveform signal to be stored. Further, it is also possible avoid noise generation due to termination of the. differential signal supply, by gradually decreasing the gain of the the gain control G701.

As apparent from the foregoing, it is allowed to form tone signals that last irrespective of the source sound signals, by, at a predetermined time after the initiation of tone generation, making "0" the differential sound DIFF to be given to the synthesization circuit.

Although the gain Gi has been described as automatically changed by the control section 3, the gain Gi may be changed manually. For example, the gain Gi may be manually changed during a performance by a performer using a suitable controller such as a performance assisting operator wheel. Of course, a wide variety of tones can be generated by varying the characteristics of the delay circuit D601 and filter F601.

Figure 4:
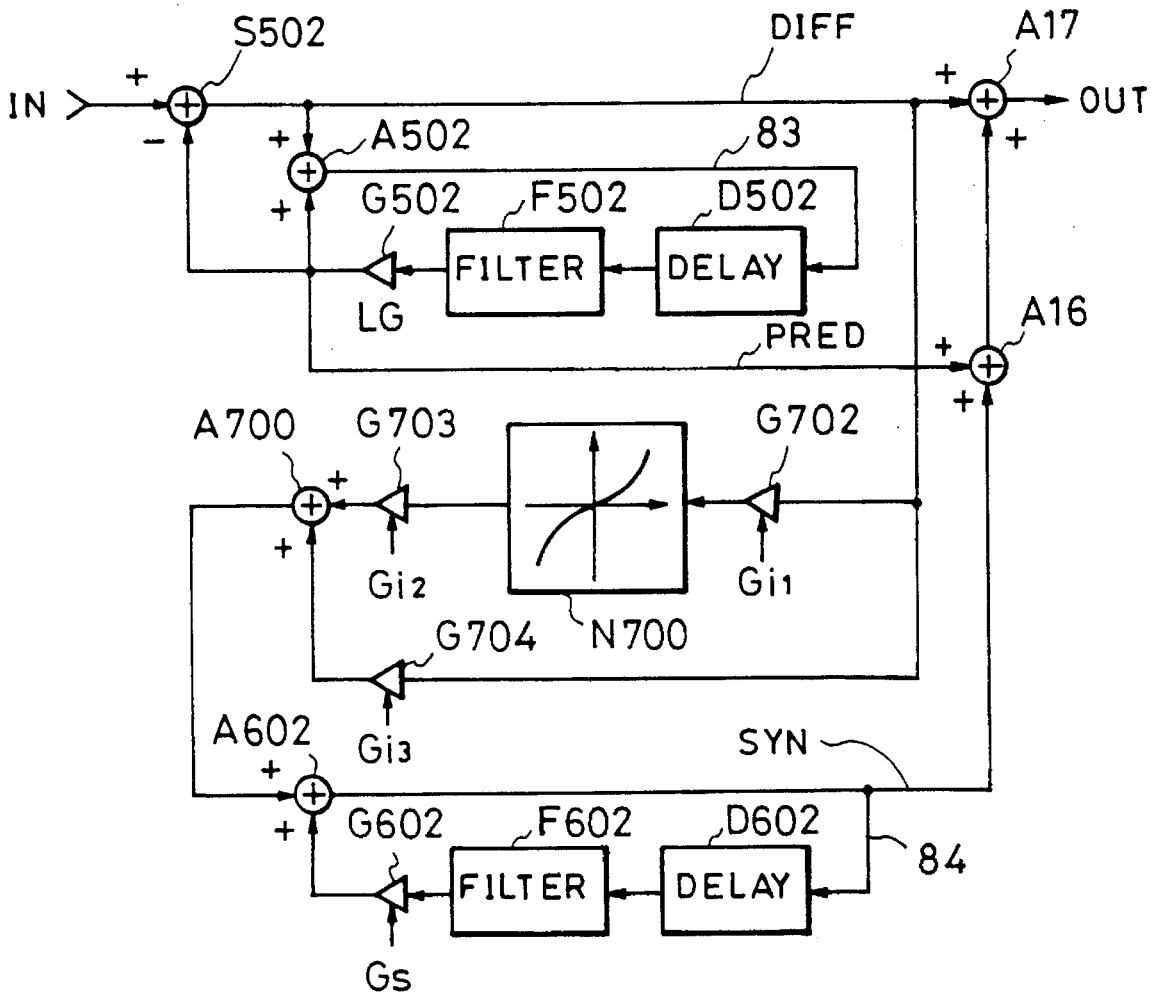
FIG. 4 is a block diagram of still another embodiment of a tone signal synthesis device in accordance with the present invention.

FIG. 4 shows a third embodiment of the present invention in which a non-linear circuit is inserted between an analyzation circuit and a synthesization circuit. The analyzation circuit comprises a loop circuit 83 including an adder A502, a delay circuit D502, a filter F502 and a gain control G502, and a subtracter S502. The subtracter S502 subtracts an output signal of the gain control G502 received at its "–" terminal from a source sound signal IN received at its "+" terminal, so as to form a differential sound DIFF.

The differential sound DIFF is applied to one input terminal of the adder A502 and is also extracted as an output of the analyzation circuit which is then supplied to an adder A17 and gain controls G702 and G704. A predicted sound PRED formed by the gain control G502 is extracted as an output of the synthesization circuit which is then supplied to an adder A16.

The differential sound DIFF supplied to the gain control G702 is subjected to non-linear conversion by a serial connection of the gain control G702, non-linear circuit N700 and gain control G703 and is then applied to one input terminal of an adder A700. The differential sound DIFF supplied to the gain control G704 is imparted a gain Gi3 thereby and is then applied to the other input terminal of the adder A700. The output signal from the adder A700 is given to an adder A602 of the synthesization circuit.

The synthesization circuit of FIG. 4 comprises a loop circuit 84 including the adder A602, a delay circuit D602, a filter F602 and a gain control G602. A synthesized sound SYN formed by the adder A602 is extracted as an output of the synthesization circuit so as to be supplied to the adder A16.

The adder A16 adds the predicted sound PRED extracted from the analyzation circuit and the synthesized sound extracted from the synthesization circuit, and it supplies the added result to the adder A17. The adder A17, in turn, adds the differential sound DIFF extracted from the analyzation circuit and the output signal of the adder A16, so as to form output signal OUT.

By passing the differential sound DIFF through the non-linear circuit to the loop circuit 84, the loop circuit 84 will be provided with harmonic component etc. that are not present in the source sound signal IN.

In addition, tone color can be changed during a performance, by controlling the gains Gi1, Gi2 and Gi3 of the gain controls G702, G703 and G704 via a performance assisting operator or wheel, keyboard touch or an envelope generator.

For example, by increasing the gain Gi 1, the non-linear effect is increased so that the amount of imparted harmonics increases. Thus, it is allowed to impart a distortion-like effect while maintaining the characteristics of the source sound.

There may sometimes be cases where tone pitch is varied by operating the performance assisting wheel or operator during a performance, in order to produce tones rich in variations. As tone pitch is caused to vary during tone generation by such a performance operation, the difference between the source sound signal IN and the predicted sound PRED increases so that the amplitude of the differential sound DIFF will increase, thus resulting in increase in the non-linear effect. In this manner, it is permitted to yield a distortion-like effect while varying tone pitch during a performance.

FIGS. 5A to 5D show a fourth embodiment of the present invention which is intended for achieving tone color variations by the use of modulators.

Figure 5A:
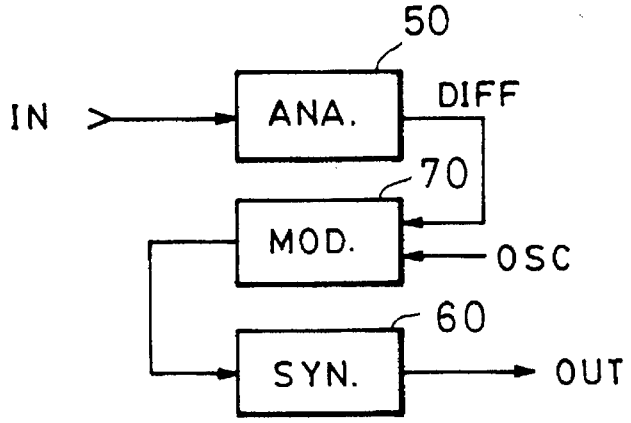
FIG. 5A is a block diagram of still another embodiment of a tone signal synthesis device in accordance with the present invention.

In FIG. 5A, there is shown an example in which a modulator circuit 70 is inserted between an analyzation circuit 50 and a synthesization circuit 70. A differential sound DIFF is amplitude- or frequency-modulated by means of the modulator circuit 70 and is then fed to the synthesization circuit 60. The synthesization circuit 60 synthesizes a tone signal on the basis of the modulated signal supplied from the modulator circuit 70, so as to form output signal OUT.

Figure 5B:
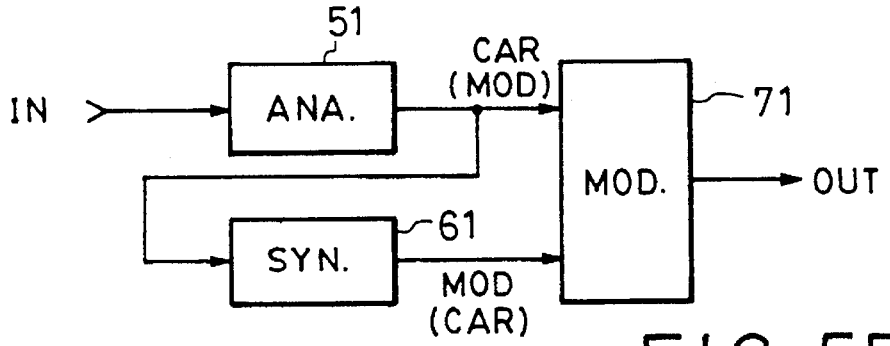
FIG. 5B is a block diagram of still another embodiment of a tone signal synthesis device in accordance with the present invention.

In FIG. 5B, there is shown another example in which frequency modulation is performed using one of output signals of analyzation and synthesization circuits 51 and 61 as a carrier wave and using the other of the output signals as a modulating wave. To a modulator 71 are supplied the respective output signals of the analyzation and synthesization circuit 51 and 61. The output signal of the analyzation circuit 51 may be either a differential sound DIFF or a predicted sound PRED. The modulator 71 performs frequency modulation using one of the output signals of analyzation and synthesization circuits 51 and 61 as a carrier wave and using the other of the output signals as a modulating wave.

Figure 5C:
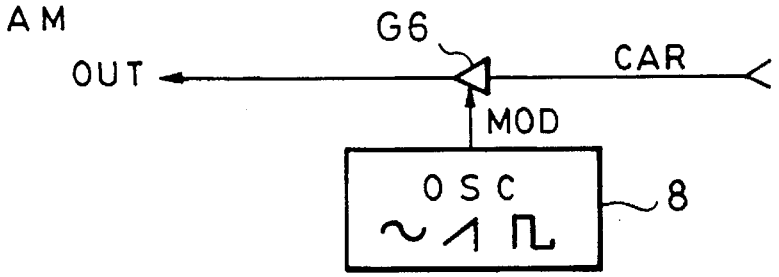
FIG. 5C is a block diagram of an example of a modulator employed in the synthesis device of FIG. 5A.

FIG. 5C is a block diagram of the amplitude modulator that is employed in the example of FIG. 5A. A carrier wave is input to a gain control G6 which is controlled by a modulating wave MOD such as a sine wave, sawtooth wave or square wave. The frequency of the modulating wave MOD may be made either synchronous or asynchronous with the pitch of tone signal constituting the carrier wave. Thus, the carrier wave CAR is amplitude-modulated by the modulating wave MOD so as to obtain amplitude-modulated output signal OUT.

Figure 5D:
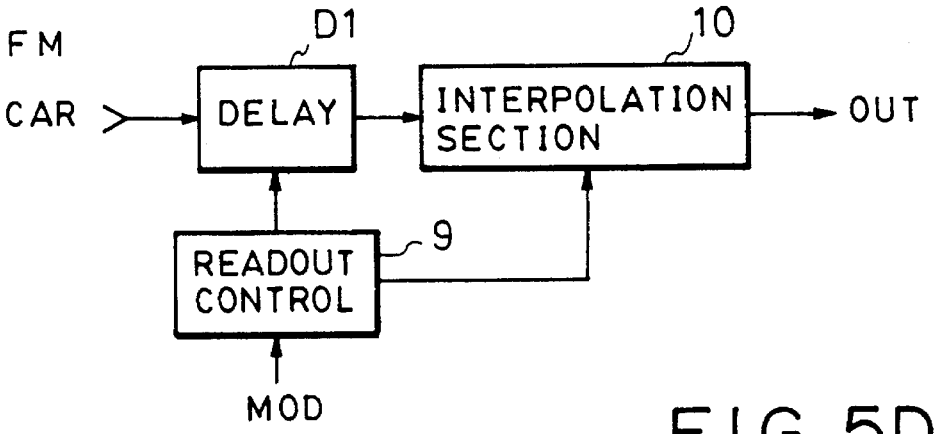
FIG. 5D is a block diagram of an example of a modulator employed in the synthesis device of FIG. 5D.

FIG. 5D shows, in block diagram, the frequency modulator that is employed in the examples of FIGS. 5A and 5B. This frequency modulator is the same as the one disclosed in Japanese Patent Laid-open Publication No. 60-263997. A carrier wave CAR is supplied to a delay circuit D1, while a modulating wave MOD is supplied to a readout control section 9. The delay circuit D1 includes a shift register having a predetermined number of shift stages or a DRAM performing a function of the shift register, from which waveform data of each storage location can be read out. The output of the last stage of the delay circuit D1 is given to an interpolation section 10.

The readout control section 9 reads out waveform data from a storage location of the delay circuit D1 which corresponds to time-variation of the modulating wave MOD and supplies the read-out waveform data to the interpolation section 10. The thus-obtained output signal of the readout control section 9 represents a result of modulation of the carrier wave CAR by the modulating wave MOD. By performing interpolation on the basis of the signals received from the delay circuit D1 and readout control section 9, the interpolation section 10 forms successive frequency-modulated signals OUT.

As has been mentioned so far, a novel tone can be created on the basis of the original or source sound signal, by modulating the differential sound to be supplied to the synthesization circuit using an arbitrary waveform, or by performing frequency modulation using one of the output signals of the analyzation and synthesization circuits 51 and 61 as a carrier wave and using the other of the output signals as a modulating wave.

Figure 6:
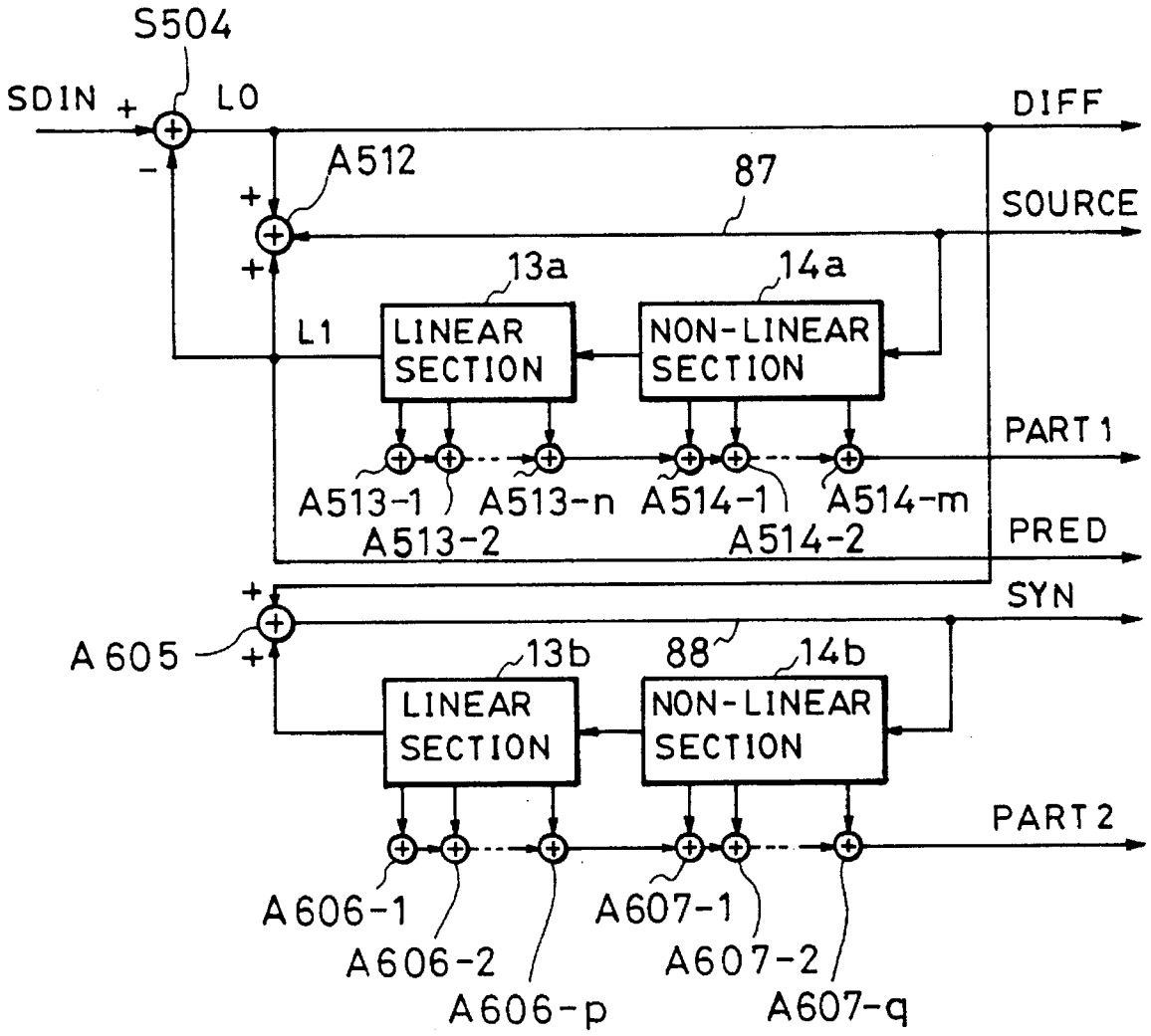
FIG. 6 is a block diagram of still another embodiment of a tone signal synthesis device in accordance with the present invention.

FIG. 6 shows a fifth embodiment of the present invention in which a non-linear circuit is inserted in a loop circuit constituting an analyzation or synthesization circuit. The analyzation circuit comprises a loop circuit 87 including an adder A512, a non-linear section 14*a* and a linear section 13*a*, and a subtracter S504. The subtracter S504 subtracts the output signal of the linear section 13*a* received at its minus input terminal from a source sound signal received at its plus input terminal, so as to produce a differential sound DIFF. The differential sound DIFF is applied to one input terminal of the adder A512 to excite a resonant sound in the loop circuit 87. The output signals of the subtracter S504, the adder A512 and the linear section 13*a* are extracted as a differential sound DIFF, source sound SOURCE and predicted sound PRED, respectively.

Further, the synthesization circuit comprises a loop circuit 88 including an adder A605, a non-linear section 14*b* and a linear section 13*b*. The differential sound DIFF output from the above-mentioned analyzation circuit is applied to one input terminal of the adder A605 to excite a resonant sound in the loop circuit 88. The output signal of the adder A605 is taken out of the synthesization circuit as a synthesized sound SYN.

By equalizing the loop circuits 87, 88 of the analyzation and synthesization circuits, it is allowed to reproduce a source sound signal even in a case where a non-linear circuit is involved. Assuming that the source sound signal received at the plus input terminal of the subtracter S504 is represented as SDIN, the output signal of the linear section 13*a* received at the minus input terminal of the subtracter S504 is represented as LI and the output signal of the subtracter S504 is represented as LO, $$SOURCE=LI+LO,$$

and $$LO=SDIN-LI,$$

so that LI and LO can be removed from the two above equations, resulting in $$SOURCE=SDIN$$

In addition since the excitation signals input to the loop circuits 87 and 88 are both equivalent to the differential sound DIFF, the synthesized sound SYN can be made equivalent to the source sound SOURCE and hence source sound signal SDIN if the characteristics of the two loop circuits are equalized.

Each of the linear sections 13*a* and 13*b* includes a filter, a delay circuit and a gain control as shown in FIG. 1, and each of the non-linear sections 14*q* and 14*b* includes a filter, a delay circuit, a gain control and a non-linear circuit as will be described below. Thus, it is possible to extract, as an intermediate signal, the signal output of each of the components contained in the linear and non-linear sections 13*a*, 13*b* and 14*a*, 14*b*. Consequently, the intermediate signals extracted from the linear and non-linear sections 13*a* and 14*a* can be added by means of adders A513-1 to A513-n and adders A514-1 to A514-m, so as to be extracted as partial sound PART1. In a similar manner, the intermediate signals extracted from the linear and non-linear sections 13*b* and 14*b* can be added by means of adders A606-1 to A606-n and adders A607-1 to A607-q, so as to be extracted as partial sound PART2.

By weighting and then adding together the thus-extracted differential sound DIFF, source sound SOURCE, predicted sound PRED, synthesized sound SYN and partial sounds PART1 and PART2 by means of an adder, it is allowed to obtain a tone signal which has been imparted a different tone color from a source sound. For example, it is allowed to generate abundant harmonics which were never achievable by the conventional arrangement including only a linear section.

Further, the analyzation circuit is not structurally restricted as long as it can provide an output in response to an input, almost limitless variations can be achieved in terms of algorithm. Thus, the use of a non-linear circuit permits impartment of a variety of tone colors even with a relatively simple arrangement. Although the linear and non-linear sections are separately provided from each other in the FIG. 6 embodiment, they are provided in a mixed fashion.

Next, a description will be made about several examples of the non-linear sections, with reference to FIGS. 7A to 7C and 8A to 8D.

Figure 7A:
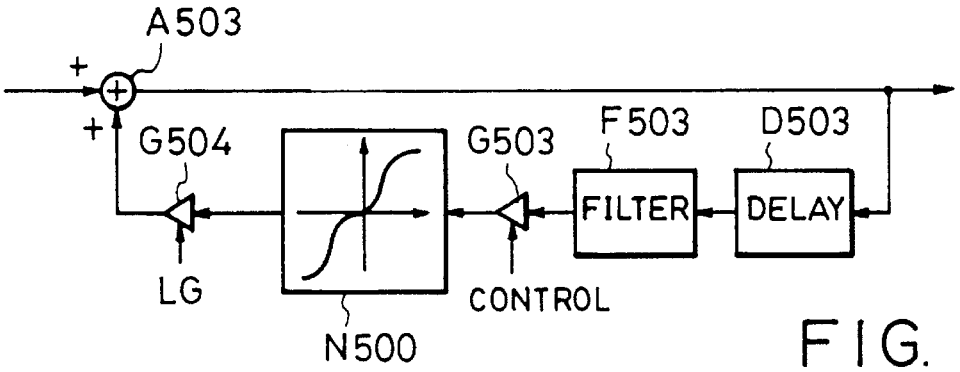
FIG. 7A is a block diagram of an example structure of a non-linear section shown in FIG. 6.

FIG. 7A shows an example in which a loop circuit is constructed of an adder A503, a delay circuit D503, a filter F503, a gain control G503, a non-linear circuit N500 and a gain control G504. Non-linear characteristic is provided by the non-linear circuit N500 in the loop circuit.

Figure 7B:
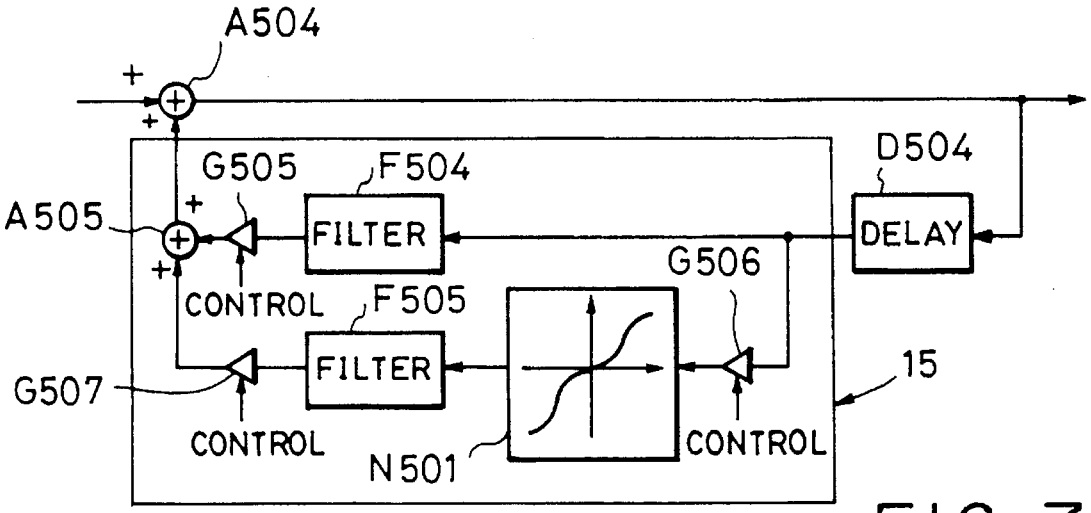
FIG. 7B is a block diagram of another example structure of the non-linear section shown in FIG. 6.

FIG. 7B shows another example in which a loop circuit is constructed of an adder A504, a delay circuit D504 and a function circuit 15. The function circuit 15 includes a first route composed of a filter F504 and a gain control G505 which are connected in series with each other, and a second route composed of a gain control G506, a non-linear circuit N501, a filter F505 and a gain control G507 which are also connected with each other.

The output signal of the delay circuit D504 is applied to the first and second circuits, and the respective output signals of the two routes are added together by an adder A505 so as to form an output signal. By controlling the respective gain values of gain controls G505 and G507, it is allowed to control the non-linear characteristics of the entire loop circuits.

Figure 7C:
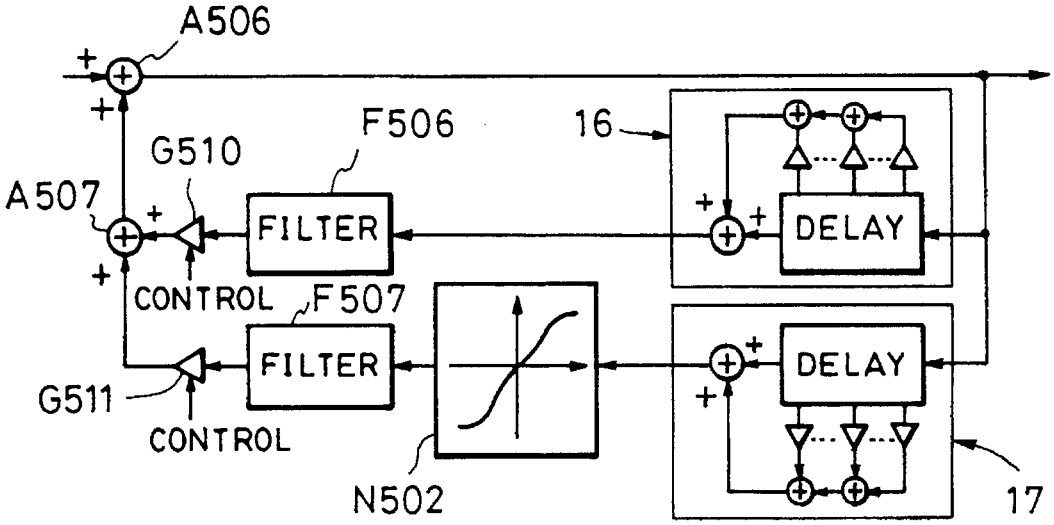
FIG. 7C is a block diagram of still another example structure of the non-linear section shown in FIG. 6.

FIG. 7C shows still another example in which a loop circuit has function circuit 16 and 17 each capable of extracting signals from intermediate taps of a delay circuit and then adding an output signal of the delay circuit and the extracted signals. The loop circuit of FIG. 7C includes a first route composed of the function circuit 16, a filter F506 and a gain control G510 which are connected in series with each other, and a second route composed of the function circuit 17, a non-linear circuit N502, a filter F507 and a Gain control G511 which are also connected in series with each other.

Harmonics structure can be controlled by extracting signals from the intermediate taps of the delay circuits as mentioned above. For instance, even-number harmonics can be emphasized by adding together signals extracted from the central parts of the delay circuits. In addition, because of the presence of the non-linear circuit N502, the non-linear characteristics can be adjusted. The output signal of an adder A506 is applied to the first and second routes, and the respective output signals of the individual routes are added together by an adder A507 to be then provided to the adder A506.

The above-mentioned non-linear circuit may be any suitable circuit that has a predetermined non-linear input/output characteristic. For example, the non-linear circuit may be such a saturation circuit which presents a linear input/output characteristic when an input value is below a predetermined value, but presents a constant saturated output when an input value is above a predetermined value.

By inserting in the loop circuit a circuit having such a non-linear characteristic, harmonic components that were not contained in a source sound signal can be excited in the loop circuit. This permits creation of various novel sounds on the basis of source sound signals.

FIGS. 8A–8D show in block diagrams several arrangements to illustrate how the characteristic of above-mentioned non-linear circuit is varied.

Figure 8A:
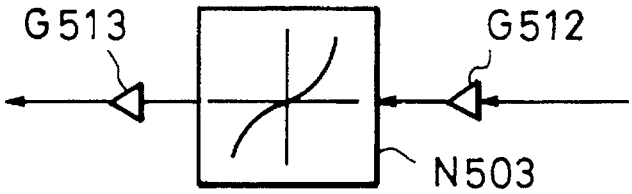
FIG. 8A is a block diagram of an example structure of a non-linear circuit.

In FIG. 8A, there is shown an example arrangement in which a gain control G512 is provided on the input side of a non-linear circuit N503 and another gain control G513 is provided on the output side of the circuit N503. In this arrangement, by incrementing or decrementing the gain value of the input-side gain control G512, the scale along the horizontal (abscissa)-axis can be varied to thereby change the intensity of a non-linear effect. On the other hand, by incrementing or decrementing the gain value of the output-side gain control G513, the scale along the vertical (ordinate)-axis can be varied to thereby adjust the feedback gain of the loop circuit.

Figure 8B:
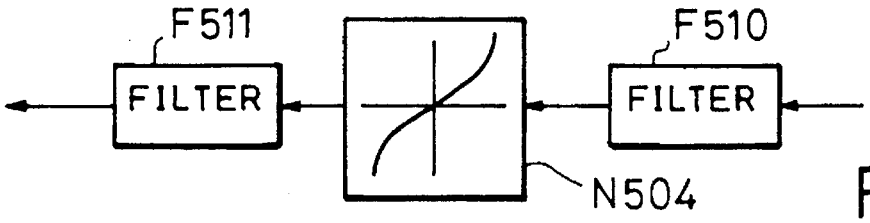
FIG. 8B is a block diagram of another example structure of the non-linear circuit.

In FIG. 8B, there is shown another arrangement in which a filter F510 is provided on the input side of a non-linear circuit N503 and another filter F511 is provided on the output side of the circuit N503. In this arrangement, the non-linear effect can be varied by varying the characteristics of the input- and output-side filters.

Figure 8C:
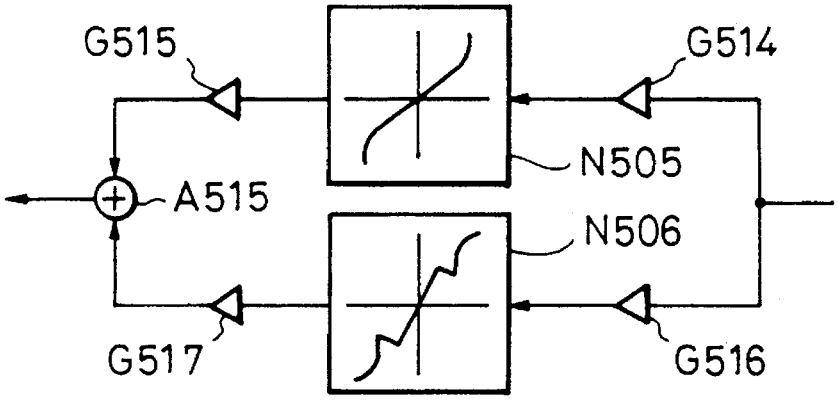
FIG. 8C is a block diagram of still another example structure of the non-linear circuit.

FIG. 8C shows another arrangement which includes a first route having a gain control G514 provided on the input side of a non-linear circuit N505 and another gain control G515 provided on the output side of the circuit N505, and a second route having a gain control G516 provided on the input side of a non-linear circuit N506 that has a different non-linear characteristic from that of the non-linear circuit N505 and another gain control G517 provided on the output side of the circuit N506. An input signal is applied to the first and second routes, and the respective output signals of the two routes are added together by means of an adder A515 so as to form an output signal. By thus employing circuits of different non-linear characteristics, it is allowed to finely control the non-linear characteristic of the loop circuit in a diversified manner.

Figure 8D:
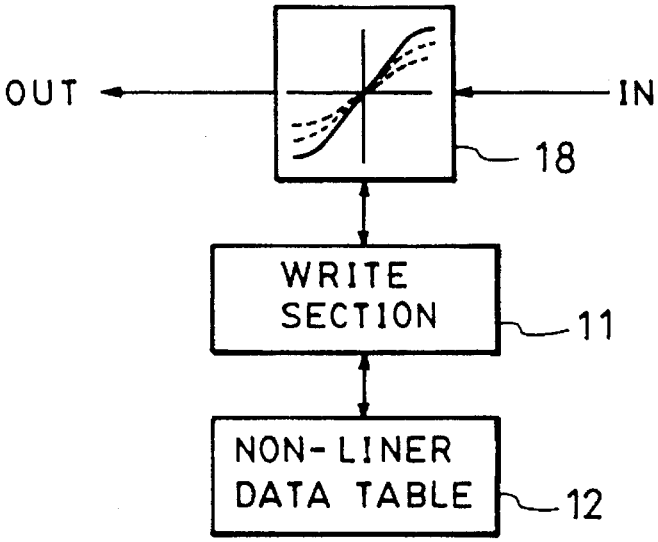
FIG. 8D is a block diagram of still another example structure of the non-linear circuit.

A non-linear circuit of FIG. 8D includes a memory 18 containing storage locations corresponding to input values, a non-linear data table 12 prestoring plural patterns of output values corresponding to the input values, and a write section 11 for reading out an output value of a desired pattern from the non-linear data table 12 and writing the read-out value into a storage location of the memory 18 corresponding to an input value.

Namely, once an input signal IN is received, the non-linear circuit reads out an output value stored at a storage location of the memory 18 so as to provide output signal OUT. With such an arrangement, it is possible to vary the non-linear characteristic by only reading out various patterns from the non-linear data table 12 to rewrite the contents of the memory 18.

Figure 9:
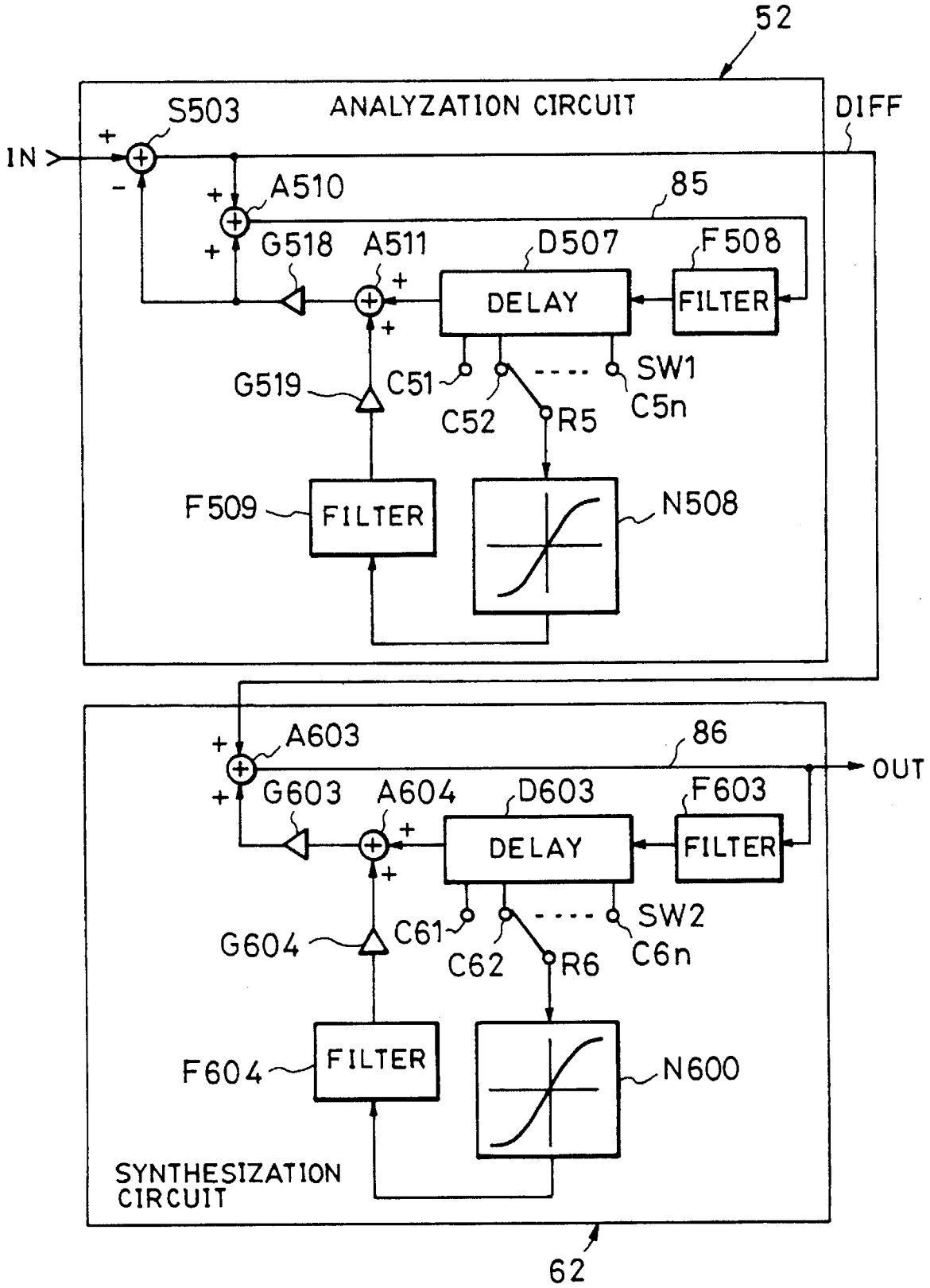
FIG. 9 is a block diagram of still another embodiment of a tone signal synthesis device in accordance with the present invention.

Further, FIG. 9 shows a sixth embodiment of the present invention, in which intermediate taps are provided in delay circuits so that a signal extracted via a desired intermediate tap is fed back to an original loop circuit through a linear circuit, filter and Gain control so as to achieve a non-linear effect.

More specifically, in the embodiment of FIG. 9, an analyzation circuit 52 includes a loop circuit 85 composed of an adder A510, s filter F508, a delay circuit D507, an adder A511 and a Gain control G518. A source sound signal IN is supplied to the plus input of a subtracter S503, and the output signal of the Gain control G518 is supplied to the minus input of the subtracter S503. Thus, the subtracter S503 subtracts the output signal of the Gain control G518 from the source sound signal IN so as to form a differential sound DIFF, which is then supplied to one input of the adder A510 as well as to a synthesization circuit The delay circuit D507 has intermediate taps C51, C52, . . . C5n, so that desired one of the intermediate taps C51, C52, . . . C5n is coupled to a switch SW1. A movable contact R5 is connected to a non-linear circuit N508 to transmit the output signal from the desired intermediate tap of the delay circuit D507 to the circuit N508. The output signal of the non-linear circuit N508 is applied to one input of the adder A511 by way of a filter F509 and a Gain control G519 so as to be feed back to the loop circuit 85.

The signal extracted from the intermediate tap of the delay circuit D507 has a shorter delay time than the output signal of the delay circuit D507 and corresponds to a predetermined harmonic component. By subjecting this harmonic component to non-linear conversion and filtering, a signal having a different characteristic is added to the main loop.

Similarly to the analyzation circuit, the synthesization circuit 62 includes a loop circuit 86 composed of an adder A603, a filter F603, a delay circuit D603, an adder A604 and a gain control G603. The delay circuit D603 also has intermediate taps C61, C62, . . . C6n, so that desired one of the intermediate taps C61, C62, . . . C6n is coupled via a switch SW2 to a movable contact R6.

The movable contact R6 is connected to a non-linear circuit N600 to transmit the output signal from the desired intermediate tap of the delay circuit D603 to the circuit N600. The output signal of the non-linear circuit N600 is applied to one input of the adder A604 by way of a filter F604 and a gain control G604 so as to be feed back to the loop circuit 86. The output signal of the adder A603 is extracted as output signal OUT of the synthesization circuit.

By selecting, via the switch SW1 or SW2, such an intermediate tap C5i or C6i ("i" represents an arbitrary number) that serves to divide the entire delay amount of the delay circuits into a simple integer ratio, a harmonious harmonic component can be emphasized. Further, by varying the characteristics of the non-linear circuits N508 and N600 and of the filters F509 and F604, it is possible to achieve various tone color variations such as addition and subtraction of harmonic component.

Although the FIG. 9 embodiment has been described as containing no non-linear circuit in the loop circuits 85 and 86, the loop circuits 85 and 86 may contain such a non-linear circuit as in the embodiment of FIG. 6.

The above-mentioned filters employed in the analyzation and synthesization circuits may comprise a low-pass filter, high-pass filter, all-pass filter or digital filter such as FIR or IIR. Further, a plurality of the mentioned filters may be used in serially-connected or parallel-connected combination. The individual circuits used for tone synthesis may be implemented by a digital signal processor (DSP) and a microprogram or by a combinational system of a microcomputer and a DSP.

As is apparent from the foregoing description, the present invention can impart a variety of tone colors to tone signals produced from various conventional tone sources such as a sampling-type tone source and FM tone source. For instance, the invention can achieve an ensemble effect and effects of emphasizing attack and resonant sounds. In addition, utterly novel sounds can be created from original sounds.

What is claimed is:

1. A tone signal synthesis device comprising:

means for providing an original sound waveform signal;

analyzing means for analyzing the original waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said first signal circulation loop;

synthesizing means for synthesizing a tone signal, said synthesizing means including a second signal circulation loop having a delay element and a filter element, said synthesizing means forwarding the first signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop;

control means for controlling parameters that determine respective processing characteristics of said analyzing and synthesizing means, independently of each other; and output means for outputting said second output signal as a tone signal.

2. A tone signal synthesis device as defined in claim 1 wherein said analyzing means includes operation means for obtaining a difference between the original sound waveform signal and a signal taken out from said first signal circulation loop, and an output signal of said operation means is supplied as an input to said first signal circulation loop.

3. A tone signal synthesis device as defined in claim 2 wherein said synthesizing means supplies the output signal of said operation means to said second signal circulation loop.

4. A tone signal synthesis device as defined in claim 1 wherein said analyzing means analyzes resonant component of said original sound waveform signal by means of said first signal circulation loop, said analyzation means further including means for analyzing a differential component between the original sound waveform signal and the analyzed resonant component.

5. A tone signal synthesis device as defined in claim 1 wherein said control means controls parameters of said delay elements and filter elements in respective ones of said first and second signal circulation loops.

6. A tone signal synthesis device as defined in claim 1 wherein said control means controls parameters that determine respective processing characteristics of said analyzing and synthesizing means, independently of each other, in accordance with a desired tonal characteristic to be synthesized.

7. A tone signal synthesis device as defined in claim 1 wherein said first and second signal circulation loops each include gain control elements.

8. A tone signal synthesis device as defined in claim 1 wherein said output means synthesizes the respective first and second output signals so as to output a resultant synthesized signal as the tone signal.

9. A tone signal synthesis device comprising:

means for providing an original compound waveform signal;

analyzing means for analyzing said original waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

synthesizing means for synthesizing said first signal, said synthesizing means including a second signal circulation loop having a delay element and a filter element, said synthesizing means forwarding the first signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for synthesizing the respective first and second output signals of said analyzing and synthesizing means so as to output a resultant synthesized signal as a tone signal.

10. A tone signal synthesis device as defined in claim 9 wherein said output means obtains signals from plural points of at least one of said first and second signal circulation loops, so as to variably control amplitudes of the obtained signals, said output means synthesizing the signals having the controlled amplitudes to produce the tone signal.

11. A tone signal synthesis device comprising:

means for providing an original sound waveform signal;

at least one analyzing system including a first signal circulation loop having a delay element and a filter element, said analyzing system supplying a signal based on the original sound waveform signal to said first signal circulation loop for processing thereby and outputting a first signal obtained from analyzing said original sound waveform signal on the basis of the processing by said loop;

a plurality of synthesizing systems each including a second signal circulation loop having a delay element and a filter element, said synthesizing systems forwarding the first signal output from said analyzing means to said second signal circulation loop for processing thereby and outputting a second signal obtained from the processing by said second signal circulation loop, wherein fundamental processing characteristics of said second signal circulation loops are in opposite functional relation to fundamental processing characteristics of said first signal circulation loops; and output means for obtaining at least the second signal output from said synthesizing systems and outputting the obtained signal as a tone signal.

12. A tone signal synthesis device as defined in claim 11 wherein said output means synthesizes the respective first and second output signals of said analyzing and synthesizing systems, so as to output a resultant synthesized signal as the tone signal.

13. A tone signal synthesis device as defined in claim 11 which further comprises one or more additional analyzing systems each including a signal circulation loop having a delay element and a filter element, and wherein the original sound waveform signal or a signal taken out from a selected point said synthesis device is input to respective signal circulation loops for processing thereby, and output signals from said loops are supplied to predetermined ones of said plurality of synthesizing systems.

14. A tone signal synthesis device as defined in claim 13 wherein said analyzing systems and synthesizing systems are connected in parallel or serial combination.

15. A tone signal synthesis device as defined in claim 11 which further comprises control means for controlling parameters that determine respective processing characteristics of said analyzing and synthesizing systems, independently of each other.

16. A tone signal synthesis device comprising:

means for providing an original sound waveform signal;

analyzing means for analyzing the original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

amplitude control means for controlling an amplitude of the first signal output from said analyzing means;

synthesizing means for synthesizing said tone signal, said synthesizing means including a second signal circulation loop having a delay element and a filter element, said synthesizing means forwarding the first output signal of said analyzing means having the controlled amplitude to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for outputting at least the second signal output from said synthesizing means as a tone signal.

17. A tone signal synthesis device as defined in claim 16 wherein said analyzing means includes operation means for obtaining a difference signal indicative of a difference between the original sound waveform signal and the first signal from said first signal circulation loop, and said amplitude control means controls an amplitude of the difference signal, said controlled amplitude difference signal being supplied to said second signal circulation loop.

18. A tone signal synthesis device as defined in claim 17 wherein said output means synthesizes the difference and second output signals of said operation and synthesizing means, respectively, so as to output a resultant synthesized signal as the tone signal.

19. A tone signal synthesis device comprising:

means for providing an original sound waveform signal;

analyzing means for analyzing the original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

non-linear conversion means for non-linearly converting the first signal output from said analyzing means and outputting a non-linear signal;

synthesizing means for synthesizing said tone signal, said synthesizing means including a second signal circulation loop having a delay element and a filter element, said synthesizing means forwarding the non-linear signal output from said non-linear conversion means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for outputting at least the second signal from said synthesizing means as a tone signal.

20. A tone signal synthesis device as defined in claim 19 wherein said non-linear conversion means variably controls at least one of a non-linear-conversion characteristic and a gain in said non-linear conversion means.

21. A tone signal synthesis device as defined in claim 19 wherein said output means synthesizes the first and second signals from said analyzing and synthesizing means, so as to output a resultant synthesized signal as the tone signal.

22. A tone signal synthesis device comprising:

means for providing an original sound waveform signal;

analyzing means for analyzing the original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

modulation means for modulating, by a modulating signal, the first signal output from said analyzing means;

synthesizing means for synthesizing said modulated first signal, said synthesizing means including a second signal circulation loop having a delay element and a filter element, said synthesizing means forwarding a modulated output signal from said modulation means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for outputting at least the second signal output from said synthesizing means as a tone signal.

23. A tone signal synthesis device as defined in claim 22 wherein said modulation means performs at least one of frequency modulation and amplitude modulation.

24. A tone signal synthesis device comprising:

means for providing an original sound waveform signal;

analyzing means for analyzing the original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

synthesizing means for processing said first signal, said synthesizing means including a second signal circulation loop having a delay element and a filter element, said synthesizing means forwarding the first signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and modulation means for performing modulation using the first and second signals output from said analyzing and synthesizing means to produce a modulated output signal; and output means for outputting said modulated output signal as a tone signal.

25. A tone signal synthesis device comprising:

means for providing an original sound waveform signal;

analyzing means for analyzing the original sound waveform signal, said analyzing means including a first signal circulation loop having a linearly processing element and a non-linearly processing element, said analyzing means supplying a signal based on the original sound waveform signal to said first signal circulation loop for processing thereby and outputting a first signal obtained from analyzing said original sound waveform signal on the basis of the processing by said loop;

synthesizing means for synthesizing said tone signal, said synthesizing means including a second signal circulation loop having a linear processing element and a non-linear processing element, said synthesizing means forwarding the first signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for outputting at least the second signal as a tone signal.

26. A tone signal synthesis device as defined in claim 25 which further comprises means for obtaining signals from one or more points on said linear and non-linear processing elements in each of said loops, and wherein said output means synthesizes the obtained signals to produce the tone signal.

27. A tone signal synthesis device as defined in claim 25 wherein said non-linear processing elements include a table for non-linearly converting a waveform signal.

28. A tone signal synthesis device as defined in claim 27 wherein said non-linear processing element further includes a delay element, a filter element and a gain control element.

29. A tone signal synthesis device as defined in claim 27 wherein said table comprises a memory having a re-writable non-linear conversion characteristic.

30. A tone signal synthesis device as defined in claim 27 wherein said non-linear processing element includes a plurality of said tables having different non-linear conversion characteristics so that any one of said tables is selectable as desired.

31. A tone signal synthesis device as defined in claim 25 wherein said linear processing element includes a delay element and a filter element.

32. A tone signal synthesis device comprising:

means for providing an original sound waveform signal;

analyzing means for analyzing the original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

synthesizing means for synthesizing said tone signal, said synthesizing means including a second signal circulation loop having a delay element and a filter element, said synthesizing means forwarding the first signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop; and output means for outputting at least the second signal output from said synthesizing means as said tone signal, wherein said delay element of at least one of said first and second signal circulation loops includes, in parallel, first and second delay routes having different delay times.

33. A tone signal synthesis device as defined in claim 32 wherein the delay time of said second delay route is shorter than that of said first delay route, and a relative delay time difference between said second delay route and said first delay route can be controlled so as to achieve harmonic component control.

34. A tone signal synthesis device as defined in claim 33 wherein said second delay route includes a non-linear conversion element for non-linearly converting a waveform signal.

35. A tone signal synthesis device as defined in claim 34 wherein said second delay route further includes a filter element.

36. A tone signal synthesis device as defined in claim 32 wherein said first delay route includes a signal delay line having a predetermined delay time, and said second delay route comprises a route that bypasses from an intermediate point of said delay line to additively couple to an output side of said delay line.

37. A tone signal synthesis device comprising:

means for providing an original sound waveform signal in real time in correspondence to a performance operation;

analyzing means for analyzing said original sound waveform signal, said analyzing means including a first signal circulation loop having a delay element and a filter element, said analyzing means supplying a signal based on the original sound waveform signal to said first signal circulation loop for processing thereby and outputting a first signal obtained from analyzing said original sound waveform signal on the basis of the processing by said loop;

synthesizing means for synthesizing the tone signal, said synthesizing means including a second signal circulation loop having a delay element and a filter element, said synthesizing means forwarding the signal output from said analyzing means to said second signal circulation loop for processing thereby and outputting a second signal obtained from the processing by said second signal circulation loop, wherein fundamental processing characteristics of said second signal circulation loop are in opposite functional relation to fundamental processing characteristics of said first signal circulation loop;

control means for controlling parameters that determine processing characteristics of said analyzing and synthesizing means in real time in correspondence to the performance operation; and output means for outputting at least the second signal output from said synthesizing means as the tone signal.

38. A tone signal synthesis device comprising:

means for providing an original sound waveform signal;

analyzing means for processing the original sound waveform signal to generate one or more analyzed waveform signal components;

synthesizing means for receiving and processing at least one of the analyzed waveform signal components, to thereby output a synthesized waveform signal, wherein fundamental processing characteristics of said analyzing means are in opposite functional relation to fundamental processing characteristics of said synthesizing means;

control means for controlling parameters that are used for processing in said analyzing and synthesizing means, independently of each other; and output means for outputting at least the signal output from said synthesizing means as the tone signal.

39. A tone signal synthesis device as defined in claim 38 wherein said control means varies correlation between parameters used in said analyzing means and said synthesizing means in various ways, so that waveform signals different from said original sound waveforms can be synthesized by said synthesizing means.

* * * * *